US006317924B1

(12) United States Patent
Gallagher

(10) Patent No.: US 6,317,924 B1
(45) Date of Patent: Nov. 20, 2001

(54) SELECTIVELY ROTATABLE HANDLE FOR WHEELED LUGGAGE

(76) Inventor: Mark Gallagher, 1936 Ambrosi Road, Kelowna, British Columbia (CA), V1Y 4R9

( * ) Notice: Subject to any disclaimer, the term of this patent is extended or adjusted under 35 U.S.C. 154(b) by 0 days.

(21) Appl. No.: 09/429,287

(22) Filed: Oct. 28, 1999

Related U.S. Application Data

(60) Provisional application No. 60/105,973, filed on Oct. 28, 1998.

(51) Int. Cl.[7] ..... A45C 13/00

(52) U.S. Cl. ..... 16/114.1; 16/113.1; 16/406; 16/411

(58) Field of Search ..... 16/114.1, 406, 16/111.1, 411, 422, 421, 425, 444; 190/116, 18 A, 115; 294/165; 292/333, 335, 33, 334; 403/93, 97

(56) References Cited

U.S. PATENT DOCUMENTS

| | | | | |
|---|---|---|---|---|
| 1,278,552 | * | 9/1918 | Allmand | 16/114.1 |
| 3,740,802 | * | 6/1973 | Clark | 16/124 |
| 3,805,929 | | 4/1974 | Kuwayama . | |
| 4,004,722 | * | 1/1977 | Olivier | 224/45 P |
| 4,561,526 | | 12/1985 | Winter et al. . | |
| 4,779,907 | * | 10/1988 | Yu | 292/33 |
| 4,838,396 | | 6/1989 | Krenzel . | |
| 4,928,800 | | 5/1990 | Green et al. . | |
| 4,974,802 | * | 12/1990 | Hendren | 248/181 |
| 5,197,579 | | 3/1993 | Bierber et al. . | |
| 5,265,307 | | 11/1993 | Hull et al. . | |
| 5,398,389 | * | 3/1995 | Terada et al. | 24/599.8 |
| 5,491,872 | | 2/1996 | Tserng . | |
| 5,630,521 | | 5/1997 | Waddell et al. . | |
| 5,713,441 | | 2/1998 | Chen . | |
| 5,722,118 | | 3/1998 | Hansen et al. . | |
| 5,878,853 | * | 3/1999 | DeRouen et al. | 190/116 |
| 6,047,442 | * | 4/2000 | Workman | 16/113.1 |

FOREIGN PATENT DOCUMENTS

| | | | | |
|---|---|---|---|---|
| 2332585 | * | 6/1973 | (CH) | 16/111.1 |
| 2843267 | * | 6/1973 | (DE) | 16/444 |

* cited by examiner

*Primary Examiner*—Anthony Knight
*Assistant Examiner*—Mark Williams
(74) *Attorney, Agent, or Firm*—Antony C. Edwards

(57) ABSTRACT

A selectively rotatable handle for luggage includes a grip and a base. The grip has a grip having a handle end and an opposite base end. The base is mountable to a piece of luggage. The base end is rotatably mounted to the base. Teeth on the base releasably engage opposed facing teeth on the base end. The opposed facing teeth are urged into interlocking engagement by a spring.

20 Claims, 3 Drawing Sheets

SELECTIVELY ROTATABLE HANDLE FOR WHEELED LUGGAGE

CROSS REFERENCE TO RELATED APPLICATION

This application claims priority from U.S. Provisional patent application No. 60/105,973 filed Oct. 28, 1998 titled Selectively Rotatable Handle For Wheeled Luggage.

FIELD OF THE INVENTION

This invention relates to the field of ergonometrically designed detachable handles for wheeled containers, luggage and the like, where such handles are selectively rotatable by the user to a preferred comfort position which places minimal tension and rotative stress on the joints of the wrist, elbow and shoulder. The handle is designed to also provide an auxiliary lifting means for luggage.

BACKGROUND OF THE INVENTION

Luggage of the type which is designed primarily to be rolled either beside or behind the traveller presently has several inherent faults. Large luggage pieces must be rolled either by griping a flexible strap and pulling the pieces along behind or by gripping the conventional lifting handle and pushing the suitcase along at ones' side. More compact luggage pieces require the user to grip a rigid extendible handle attached to the suitcase and either pull or push the luggage. In the foregoing examples the traveller has no means of repositioning the gripping arm to realign the wrist, elbow and shoulder and to thereby relieve muscular or joint discomfort.

It is therefore an object of the present invention to provide an auxiliary handle which can be readily attached to a handle on rolling type transportable containers such as wheeled golf bag carriers or suitcases or the like which will permit ready selective rotation of the handle so as to reposition an arm of a user relative to the fixed handle of the container to achieve the most advantageous and comfortable position for transport of the container and thereby avoid the pain associated with joint and muscular stress. It is also an object of the present invention to provide a handle which once selectively positioned as desired by the user, will retain the position until selectively repositioned by the user.

In the prior art, applicant is specifically aware of U.S. Pat. No. 5,722,118 which issued Mar. 3, 1998 to Hansen et al for a Handle Conversion Apparatus. Hansen teaches converting the pre-existing handle of a wheeled object such as a suitcase by attaching to the handle of the suitcase a hand grip. The hand grip is rotatable about an axis substantially perpendicular to a grip member of the suitcase handle. What is neither taught nor suggested, and which it is an object of the present invention to provide, is a means for releasably locking such a grip into a rotational position about that axis which is comfortable and ergonomically beneficial to a user.

SUMMARY OF THE INVENTION

The selectively rotatable handle of the present invention for wheeled luggage and the like includes a grip for gripping by a user. The grip comprises a shank of circular or elliptical cross section having at a first end thereof a cantilevered handle and at a second end thereof a butt. The butt generally extends at right angles to the handle and is spaced therefrom by an integrally formed intermediate curved portion of the shank. A longitudinal axis extending through the butt generally bisects the handle at a right angle.

The grip further includes a base for attaching the grip to luggage. In one embodiment the base is rigidly mounted to the luggage. In a further embodiment the base is releasably mountable onto the luggage, for example, to the luggage handle. The base may comprise an elongated grapple which may be releasably positioned over the luggage handle.

The base may have formed thereon an upper housing. The upper housing may have an annular collar defining a first cylindrical passage aligned with the longitudinal axis of the butt when the butt is mounted in the housing. Elongated shoulders of the base extend at right angles to the butt. A correspondingly elongated grapple arm depends therefrom along the full length of the shoulders and upper housing. In one preferred embodiment, the grapple arm and shoulders form, in cross section, a "C"-shape, the lower portion of the arm forming an upturned hook. A handle of a suitcase or the like may be releasably snugly mated within the "C"-shaped elongated grapple.

The first cylindrical passage is sized to accept the end of the butt journalled therein. A lower second cylindrical passage of larger diameter than the first cylindrical passage is formed adjacent and coaxial with the first cylindrical passage. A flared or enlarged end of the butt, or a swivel piece mounted to the butt, is journalled in the second cylindrical passage. The end of the butt or swivel has a first radial array of corrugations or teeth formed thereon. The corrugations or teeth extend radially outwardly from, in radially spaced array around, the longitudinal axis of the first and second cylindrical passages.

The first radial array of corrugations or teeth are in opposed facing mating relation to a second radial array of corrugations or teeth on an annular inner face on the shoulder between the first and second cylindrical passages.

An annular groove is formed in the wall around the second cylindrical passage and is spaced from the second radial array of corrugations or teeth. The groove is sized to accept a rigid planar end disk in mating engagement therein so as to form a rigid wall across the end of the second cylindrical passage. Resilient biasing means, for example, in the form of a resilient clover-leaf spring, coil spring or the like, is sandwiched between the end of the butt or swivel journalled in the second cylindrical passage and the end disk. The resilient biasing means urges the first and second arrays of corrugations or teeth against one another.

When the handle is tensioned, as by pulling of the luggage, the teeth or corrugations are interlockingly mated so as to resist rotation of the grip about the longitudinal axis of the first and second cylindrical passages. Pushing the grip against the return biasing force of the biasing means disengages the mating of the first and second radial arrays of corrugations or teeth allowing rotation of the grip.

Since the grip portion is bisected by the longitudinal axis of the butt, which is coaxial with the longitudinal axis of the first and second cylindrical passages, the selectively rotatable handle may, firstly, be depressed against the biasing means to disengage the meshing corrugations or teeth with only minimal force and then, secondly, be selectively repositioned by rotation to a more ergonomically advantageous position relative to the wrist, elbow and shoulder joints of the user during use of the grip.

In summary, the selectively rotatable handle of the present invention comprises a grip and a base. The grip has a handle end and an opposite base end. The base is mountable to a piece of luggage. The base end is rotatably mounted to the base. By reference to "mountable", it is intended this include that the base may be incorporated as part of the piece of luggage, e.g. suitcase or any other container, or may be detachable from the piece of luggage.

A first interlocking means on the base releasably engages a second interlocking means on the base end. The first and second interlocking means are in opposed facing relation. The first and second interlocking means are urged into interlocking engagement by a resilient biasing means.

Advantageously, the first and second interlocking means are opposed facing radially spaced first and second arrays of teeth radially spaced around a first axis generally perpendicular to the handle end. Further, the base may comprise a hollow housing, the base end swivel-mounted in the hollow housing so as to be rotatable about, and translatable along, the first axis. In this embodiment the first array of teeth are mounted to an inner surface of the housing and the second array of teeth are mounted to the base end.

The resilient biasing means, which may be a spring, is mounted within the housing so as to resiliently urge the base end along the first axis in a first direction so as to mesh the first and second arrays of teeth together. In one embodiment, the resilient biasing means may be mounted sandwiched in between the base end and an interior floor surface of the hollow housing.

In one aspect of the present invention, the base end comprises a shaft swivelmounted to the housing through an aperture in the housing. The shaft and the aperture are coaxial with the first axis. The inner surface of the housing is an annular shoulder, interior to the housing, around the aperture. The base end further comprises, at a distal end thereof, a radially enlarged annular platform such as a rigid disk. The second array of teeth are mounted around the annular platform or disk.

In a further embodiment, the base comprises a grapple releasably mountable to the piece of luggage, for example to the luggage handle. In this embodiment, the grapple may be a C-shaped channel releasably mountable onto the luggage handle. The C-shaped channel may be elongate so as to extend from either side of the housing.

In a further aspect of the present invention, the handle end is elongate and mounted to the base end by a shank. The base end may be releasably mounted by a releasable coupler to the shank.

DETAILED DESCRIPTION OF PREFERRED EMBODIMENTS

Figure 1:
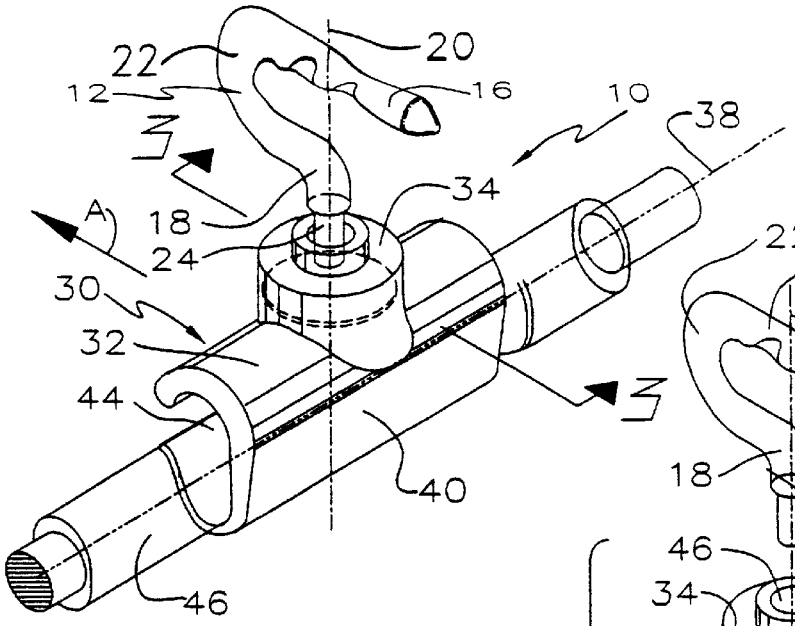
FIG. 1 is an isometric view illustrating the handle of the present invention.
Figure 2:
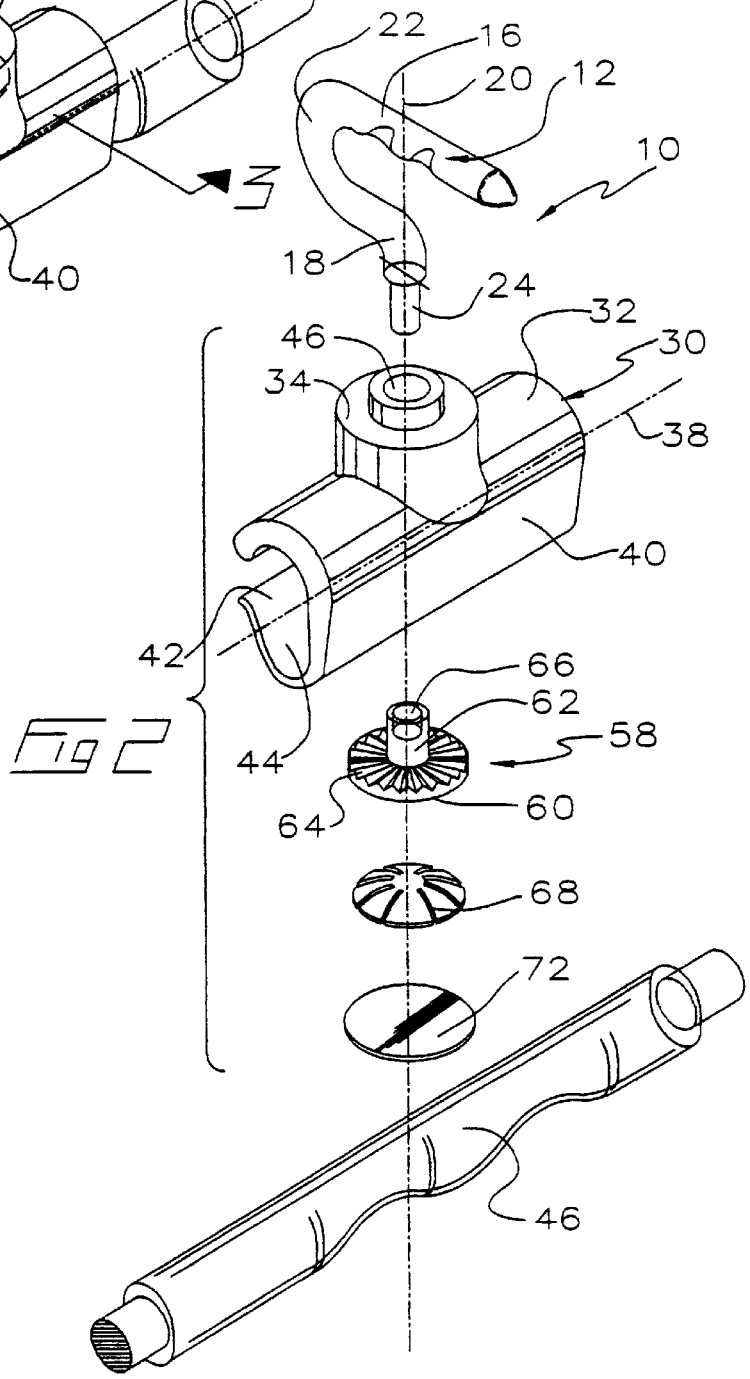
FIG. 2 is an exploded isometric view illustrating the handle of FIG. 1.
Figure 3:
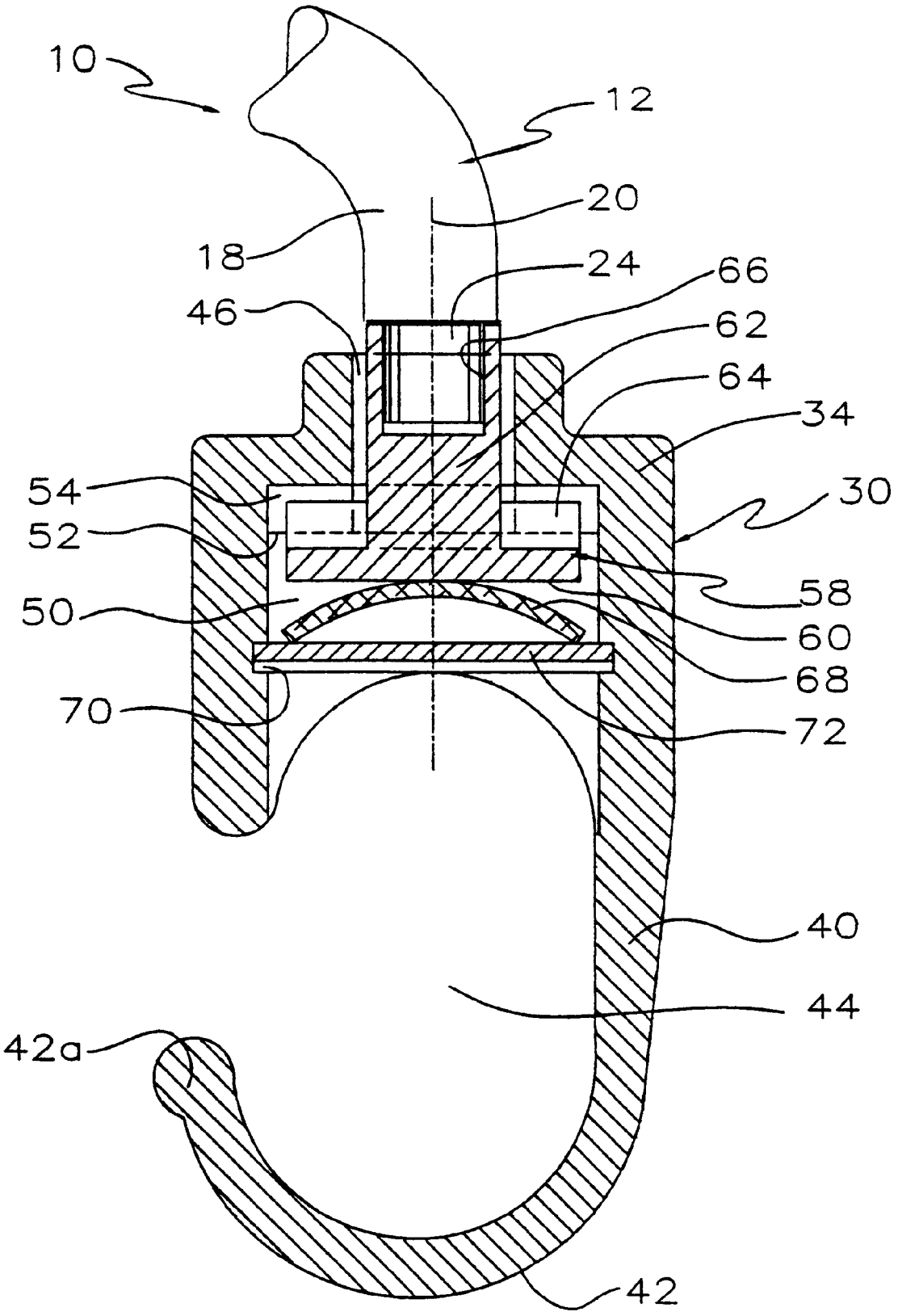
FIG. 3 is a partially cut-away sectional view along line 3—3 in FIG. 1.

As illustrated in FIGS. 1–3, a selectively rotatable handle 10, comprises a grip 12 and a base. Grip 12 has a cantilevered handle 16, of circular or elliptical cross section at a first end and a butt 18, at an opposite second end. A longitudinal axis 20, extends through the butt 18 and generally bisects handle 16, at a right angle. Handle 16 and butt 18 are held rigidly spaced apart intersecting along the longitudinal axis 20 by an integrally formed intermediate curved shank 22. The lowermost end of butt 18 is advantageously of reduced diameter so as to form shaft 24.

The base provides a means for attaching the grip to a luggage handle, and may take the form of elongated grapple 30. Grapple 30 has elongated upper shoulders 32 encircling, and formed integrally therewith, an upper housing 34. Longitudinal axis 38 of grapple 30, is generally at right angles to axis 20.

Depending downwardly from a first side of shoulders 32 is an arm 40. Arm 40 is generally planar and extends the full length of shoulders 32. Arm 40 terminates in an upturned hook or shelf 42 in oppositely disposed relation to shoulders 32. Upturned shelf 42 extends the width of, and length of, shoulders 32 and upper housing 34. The free edge 42*a* of shelf 42 is in substantially vertical alignment with, but spaced from, a second side of shoulders 32 opposite the first side, so as to form in cross-section a "C"-shaped channel 44. The "C"-shaped channel is sized to snugly receive therein a handle 46 of a suitcase or the like.

The upper housing 34, has a cylindrical first passage 46, formed coaxially with axis 20. First passage 46 is sized to accept the lowermost end of butt 18, i.e., shaft 24, when journalled therein. A cylindrical second passage 50, of larger diameter than first passage 46 is formed within upper housing 34. Second passage 50 is formed coaxial to first passage 46. The annular shoulder between the first and second passages is formed as an annular inner face 52. Inner face 52 has corrugations or teeth 54 which extend symmetrically in a radially spaced array outwardly of axis 20.

Swivel 58 provides a selectively rotatable joint between grip 12 and grapple 30. Swivel 58 terminates at its lowermost end with a disk 60. An integrally formed vertically extending cylindrically stem 62 is mounted to disk 60 at right angles to the disk so as to be coaxial with axis 20. Stem 62 has a cylindrical cavity 66 formed within the end of the stem remote from disk 60, into which the shaft 24 may be rigidly or releasably mounted into cavity 66.

Disk 60 has on its exposed annular upper face a radially extending spaced array of corrugations or teeth 64, radially spaced about stem 62. Corrugations or teeth 64 are in opposed facing relation with, so as to mate with, when pressed against, corrugations or teeth 54.

Grip 12 may be retained in a preselected position by the resilient urging of clover-leaf spring 68 or the like. Leaf spring 68 may be a resilient plastic hemisphere, the perimeter of which has a plurality of radially spaced cuts or denticulations to permit compression of the spring. The spring is supported within passage 50 by a retainer disk 72 mounted in an annular recess or groove 70 formed in the passage wall. Recess 70 lies in a plane at right angles to axis 20. Disk 72 closes passage 50 and retains spring 68 pressed against the underside of disk 60. This maintains opposed facing contact between corrugations 54 and 64.

Selective rotation of handle 16, to thereby position the handle to its most ergonomically advantageous alignment about axis 20 such as illustrated in FIG. 1 is accomplished by applying downwards pressure on the handle sufficient to compress spring 68 and to disengage mating of corrugations 54 and 64. Handle 16 may then be rotated so as to be repositioned. The downwards pressure is then released to permit the spring to re-engage corrugations 54 and 64 at the newly selected position.

When the handle is tensioned, as by pulling of the luggage in its direction of translation A, the teeth or corrugations are interlockingly mated so as to resist rotation of the grip about the longitudinal axis of the first and second cylindrical passages. Pushing the grip against the return biasing force of the biasing means disengages the mating of the first and second radial arrays of corrugations or teeth allowing rotation of the grip.

Figure 4:
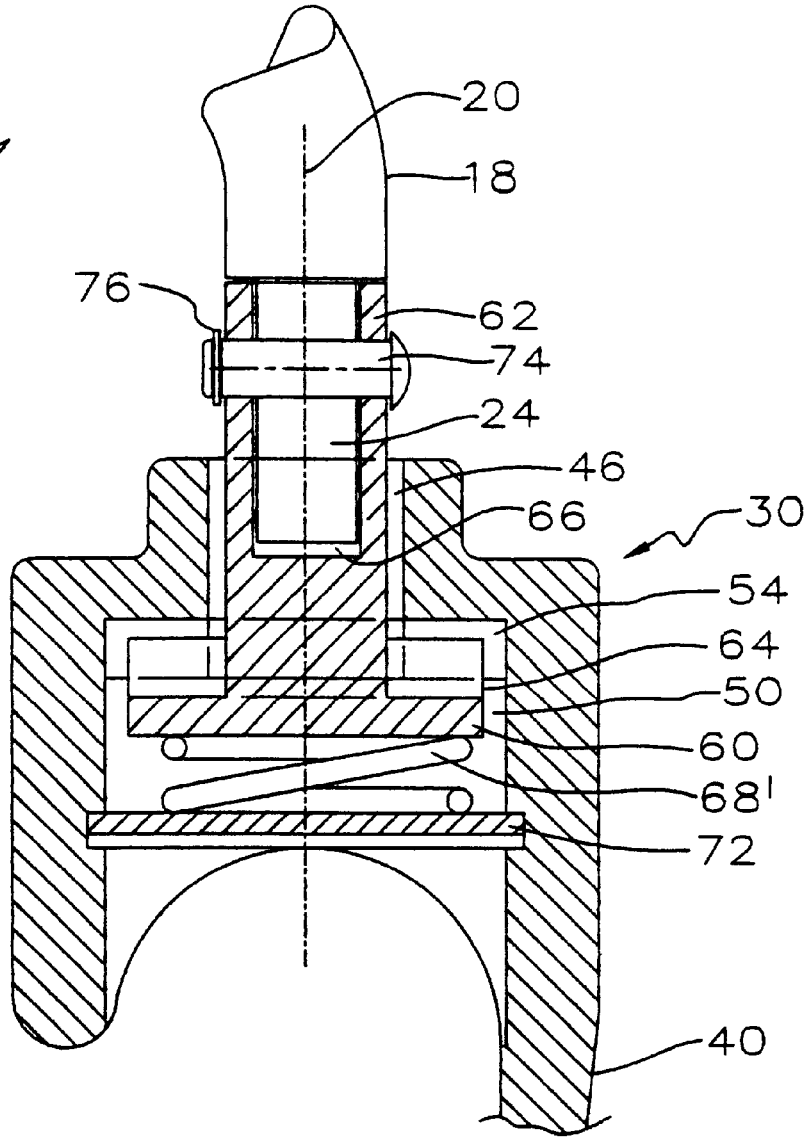
FIG. 4 is a partially cut-away sectional view of an alternative embodiment along line 3—3 in FIG. 1.
Figure 5:
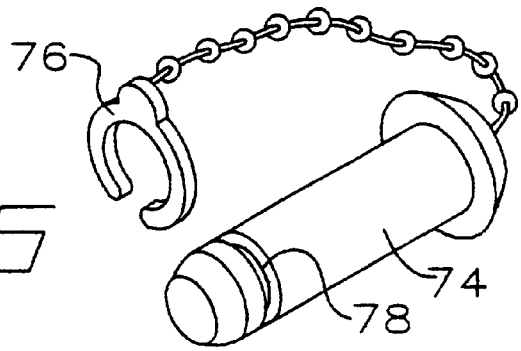
FIG. 5 is an isometric view of a securing pin of the embodiment of FIG. 4.

In the alternative embodiment of FIGS. 4 and 5, leaf spring 68 is replaced with helical coil spring 68 '. Shaft 24 is releasable secured within cavity 66 by means of pin 74 journalled through corresponding apertures in shaft 24 and the upper end of stem 62. The pin may be retained in the apertures by use of resilient clip 76 engaging annular groove 78. The form of the spring and pin are not intended to be limiting as other resilient urging means and releasable mounting means, respectively, would also work.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A selectively rotatable handle for luggage comprising:

a grip having a handle and an opposite base end, a base mountable to a piece of luggage, said base end rotatably mounted to said base for rotation of said handle relative to said base about a pull axis of said luggage along which a user pulls when grasping said handle and translating said luggage, said handle generally perpendicular to said pull axis, a first interlocking means on said base releasable engaging, in a plane generally orthogonal to said pull axis, a second interlocking means on said base end, said first and second interlocking means in opposed facing relation about said plane, said first and second interlocking means urged into interlocking engagement by a resilient biasing means, wherein rotation of said handle about said pull axis provides for reorientation of a wrist of said user when grasping said handle and pulling along said pull axis to a position wherein said handle lies generally in a plane containing said pull axis and said direction of translation of said luggage.

2. The device of claim 1 wherein said first and second interlocking means are opposed facing radially spaced first and second arrays of teeth radially spaced around said pull axis.

3. The device of claim 2 wherein said base comprises a hollow housing and said base end is swivel-mounted into said hollow housing so as to be rotatable about and translatable along said pull axis, and wherein said first array of teeth are mounted to an inner surface of said housing and said second array of teeth are mounted to said base end.

4. The device of claim 3 wherein said resilient biasing means is mounted within said housing so as to resiliently urge said base end along said pull axis in a first direction so as to mesh said first and second arrays of teeth together.

5. The device of claim 4 wherein said resilient biasing means is mounted sandwiched in between said base end and an interior floor surface of said hollow housing.

6. The device of claim 5 wherein said resilient biasing means is a spring.

7. A selectively rotatable handle for luggage comprising:

a grip having a handle end and an opposite base end, a base mountable to a piece of luggage, said base end rotatable mounted to said base, a first interlocking means on said base releasably engaging a second interlocking means on said base end, said first and second interlocking means in opposed facing relation, said first and second interlocking means urged into interlocking engagement by a resilient biasing means, wherein said first and second interlocking means are opposed facing radially spaced first and second arrays of teeth radially spaced around a first axis generally perpendicular to said handle end.

wherein said base comprises a hollow housing and said base end is swivel-mounted into said hollow housing so as to be rotatable about and translatable along said first axis, and wherein said first array of teeth are mounted to an inner surface of said housing and said second array of teeth are mounted to said base end, wherein said resilient biasing means is mounted within said housing so as to resiliently urge said base end along said first axis in a first direction so as to mesh said first and second arrays of teeth together, wherein said resilient biasing means is mounted sandwiched in between said base end and an interior floor surface of said hollow housing, wherein said resilient biasing means is a spring, and wherein said base end comprises a shaft swivel-mounted to said housing through an aperture in said housing, said shaft and said aperture coaxial with said first axis, and wherein said inner surface of said housing is an annular shoulder, interior to said housing, around said aperture, and wherein said base end further comprises, at a distal end thereof, a radially enlarged annular platform, said second array of teeth mounted around said annular platform.

8. The device of claim 7 wherein said annular platform is a rigid disk.

9. A selectively rotatable handle for luggage comprising:

a grip having a handle end and an opposite base end, a base mountable to a piece of luggage, said base end rotatably mounted to said base, a first interlocking means on said base releasably engaging a second interlocking means on said base end, said first and second interlocking means in opposed facing relation, said first and second interlocking means urged into interlocking engagement by a resilient biasing means, wherein said base comprises a grapple releasably mountable to said piece of luggage.

10. The device of claim 9 wherein said piece of luggage is a luggage handle and said grapple is a C-shaped channel releasably mountable onto said luggage handle.

11. The device of claim 10 wherein said base further comprises a housing and wherein said C-shaped channel is elongate and extends from either side of said housing.

12. The device of claim 11 wherein said first and second interlocking means are opposed facing radially spaced first and second arrays of teeth radially spaced around a first axis generally perpendicular to said handle end.

13. The device of claim 12 wherein said base comprises a hollow housing and said base end is swivel-mounted into said hollow housing so as to be rotatable about and translatable along said first axis, and wherein said first array of teeth are mounted to an inner surface of said housing and said second array of teeth are mounted to said base end.

14. The device of claim 13 wherein said resilient biasing means is mounted within said housing so as to resiliently urge said base end along said first axis in a first direction so as to mesh said first and second arrays of teeth together.

15. The device of claim 14 wherein said resilient biasing means is mounted sandwiched in between said base end and an interior floor surface of said hollow housing.

16. The device of claim 15 wherein said resilient biasing means is a spring.

17. The device of claim 14 wherein said base end comprises a shaft swivel-mounted to said housing through an aperture in said housing, said shaft and said aperture coaxial with said first axis, and wherein said inner surface of said housing is an annular shoulder, interior to said housing, around said aperture, and wherein said base end further comprises, at a distal end thereof, a radially enlarged annular platform, said second array of teeth mounted around said annular platform.

18. The device of claim 17 wherein said annular platform is a rigid disk.

19. The device of claim 17 wherein said handle end is elongate and mounted to said base end by a shank.

20. The device of claim 19 wherein said base end is reasonable mounted by a releasable coupler to said shank.

* * * * *